US007162957B2

(12) United States Patent
O'Brien et al.

(10) Patent No.: US 7,162,957 B2
(45) Date of Patent: Jan. 16, 2007

(54) REDUNDANT SIGNAL TRANSMISSION SYSTEM AND DEVELOPMENT METHOD

(75) Inventors: John O'Brien, Pawcatuck, CT (US); Thomas A. Nadeau, Granby, CT (US); Timothy J. O'Brien, Mystic, CT (US); A. Jonathan Bawabe, Bolton, CT (US); Stephen W. Bartholomew, Simsbury, CT (US); Raymond G. Niederwerfer, Manchester, CT (US)

(73) Assignee: Shock Tube Systems, Inc., Charlestown, RI (US)

( * ) Notice: Subject to any disclaimer, the term of this patent is extended or adjusted under 35 U.S.C. 154(b) by 0 days.

(21) Appl. No.: 11/407,556

(22) Filed: Apr. 19, 2006

(65) Prior Publication Data

US 2006/0185505 A1 Aug. 24, 2006

Related U.S. Application Data

(62) Division of application No. 10/667,042, filed on Sep. 22, 2003, now Pat. No. 7,086,335.

(60) Provisional application No. 60/454,758, filed on Mar. 13, 2003, provisional application No. 60/452,761, filed on Mar. 7, 2003.

(51) Int. Cl.
*C06C 5/04* (2006.01)

(52) U.S. Cl. ..... 102/275.8; 86/1.1

(58) Field of Classification Search ..... 102/275.1, 102/275.5, 275.6, 275.7, 275.8, 275.9, 275.2, 102/275.3, 275.4; 86/1.1
See application file for complete search history.

(56) References Cited

U.S. PATENT DOCUMENTS

| | | | | |
|---|---|---|---|---|
| 2,663,755 A | | 12/1953 | McBride | 174/117 R |
| 2,877,708 A | | 3/1959 | Rey | 102/275.8 |
| 3,320,883 A | | 5/1967 | Welsh | 102/275.8 |
| 3,590,739 A | | 7/1971 | Persson | 102/275.5 |
| 3,698,280 A | * | 10/1972 | Welsh | 86/1.1 |
| 3,867,884 A | | 2/1975 | Langrish-Smith | 102/275.8 |
| 4,206,706 A | * | 6/1980 | Steele | 102/275.7 |
| 4,328,753 A | | 5/1982 | Kristensen et al. | 102/275.5 |
| 4,588,459 A | * | 5/1986 | Zwilling | 156/85 |
| 4,607,573 A | | 8/1986 | Thureson et al. | 102/275.8 |
| 5,001,981 A | | 3/1991 | Shaw | 102/275.8 |
| 5,212,341 A | * | 5/1993 | Osborne et al. | 102/275.8 |
| 5,286,924 A | * | 2/1994 | Loder et al. | 174/117 F |
| 5,317,974 A | * | 6/1994 | Stewart et al. | 102/275.8 |
| 5,365,851 A | | 11/1994 | Shaw | 102/275.6 |
| 5,661,405 A | | 8/1997 | Simon et al. | 324/697 |
| 5,827,994 A | * | 10/1998 | Gladden et al. | 102/275.8 |
| 6,272,996 B1 | | 8/2001 | O'Brien et al. | 102/275.11 |
| 6,742,576 B1 | * | 6/2004 | Bergevin | 165/133 |

FOREIGN PATENT DOCUMENTS

| | | |
|---|---|---|
| EP | 0 097 414 A1 | 1/1984 |
| FR | 2446532 A | 9/1980 |
| GB | 2029629 A | 3/1980 |

* cited by examiner

*Primary Examiner*—Michael J. Carone
*Assistant Examiner*—James S. Bergin
(74) *Attorney, Agent, or Firm*—McCormick, Paulding & Huber LLP

(57) ABSTRACT

Percussive signal transmission tubes, of contrasting color, are joined along adjacent longitudinally extending portions by an adhesive bead of polymeric material. The tubes can be separated in the field and are provided on spools without any sheath. A small diameter (0.10 inch) tube can be used to reduce the size of the spool, or increase the length of tubing wound on the spool. An apparatus for assembling the product is also disclosed.

5 Claims, 2 Drawing Sheets

REDUNDANT SIGNAL TRANSMISSION SYSTEM AND DEVELOPMENT METHOD

CROSS-REFERENCE TO RELATED APPLICATION

This application is a divisional application of Ser. No. 10/667,042, filed Sep. 22, 2003 now U.S. Pat. No. 7,086,335, which claims priority from the following patent applications: U.S. Ser. No. 60/454,758, filed on Mar. 13, 2003, U.S. Ser. No. 60/452,761, filed on Mar. 7, 2003.

TECHNICAL FIELD

This invention relates to transmission of initiation signals for explosives from a point of initiation to the blast location, and more particularly to redundant signal transmission by a plurality of signal transmission tubes. A packaging method to allow rapid deployment of the signal transmission tubes is also disclosed.

BACKGROUND OF THE INVENTION

In detonating a plurality of blasting charges, transmission tubes may be deployed from a remote initiating point to transmit initiation signals to detonate individual explosive charges. Although transmission tubes have been primarily used for blast initiation in mining and quarrying applications, there are a number of other uses for transmission tubes. For example, transmission tubes have been used to transmit an automotive collision impact signal to activate a protective airbag or pre-tensioning automotive safety belts.

The aforementioned transmission tubes may be of the type disclosed in U.S. Pat. No. 3,590,739 sold under the trademark "Nonel" and sometimes referred to as "shock tube". An improved transmission tube design is disclosed in U.S. Pat. No. 4,328,753 and consists of an inner adhesive plastic layer to secure the explosive composition and an outer abrasion resistant plastic layer. As used herein, the term "transmission tube" refers to any detonating or deflagrating signal transmission tube or line including a flexible hollow tube, which can carry a detonating or deflagrating signal along its interior, which signal does not destroy the tube.

The term "signal" when used in connection with the aforementioned transmission tube is intended to refer to either the detonating shock wave or the deflagrating flame front, which is transmitted along the interior of the tube, by combustion of a reactive substance, contained therein.

In transmitting a signal in the field, the reliability of transmission tubes may be inadvertently reduced. For example, when deploying the product a sharp rock or other object may penetrate the wall of the transmission tube allowing water to enter the tube and causing a signal transmission failure.

It is therefore an object of the invention to provide a signal transmission device having improved reliability of signal transmission.

It is a further object of the invention to provide a reliable signal transmission device, capable of transmitting a plurality of signals, that is easy to handle and rapidly deploy.

It is a further object of the invention to provide a reliable signal transmission device that is easy to manufacture and facile in its use.

Other objects will be in part obvious and in part pointed out in more detail hereinafter.

A better understanding of the objects, advantages, features, properties and relations of the invention will be obtained from the following description and accompanying drawings which set forth certain illustrative embodiments and are indicative of the various ways in which the principles of the invention are employed.

SUMMARY OF THE INVENTION

A redundant signal transmission and initiation system constructed according to the present invention comprises, in its preferred embodiment, a plurality of signal transmission tubes bonded together in axially extending juxtaposed relation for substantially the entire length of the tubes between the first end of the tubes and a second end of the tubes with the bonding method being an extruded bead of plastic material having adhesive properties such that the separating force of the bonded tubers is carefully controlled. The redundant signal transmission tubes are wound on a packaging means to allow rapid deployment in field applications.

DETAILED DESCRIPTION OF CERTAIN PREFERRED EMBODIMENTS

Figure 1:
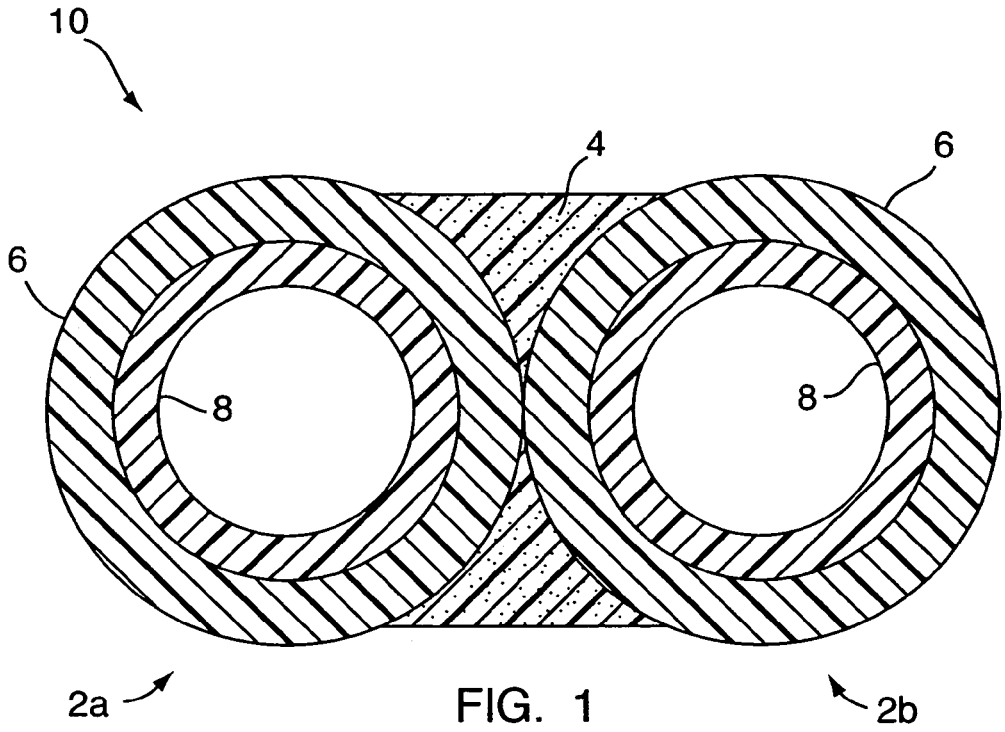
FIG. 1 is a cross sectional view of the redundant signal transmission device. Two signal transmission tubes are shown joined by a plastic bead that bonds the two tubes together.

Signal transmission tubes, or shock tubes, are widely used in the initiation of commercial blasting operations encountered in mining, quarrying, and construction. In these applications, a single shock tube will connect the blast from borehole to borehole and transmit a signal to initiate the entire blast. Since the signal transmitted is nonelectric, stray electrical currents or EMF radiation does not affect this system.

In military operations, nonelectric signal transmission systems are desirable due to their intrinsic safety. Being unaffected by electromagnetic radiation, these systems have a higher level of safety than an electric blasting system. However in military operations, demolition operations are often carried out under hostile conditions. In these situations, redundant initiation systems are required. If one signal line becomes damaged in operations, the second signal transmission line provides an alternative initiation path.

Also in military field operations, there is little time available for field assembly of components. Rapid response is the critical requirement for the military. Thus it is desirable to provide a military initiator completely assembled and packaged in the factory. A soldier in the field merely has to deploy the unit and initiate the signal transmission tubes from a safe location.

Referring in detail to drawing 1, the redundant signal transmission device of the present invention is indicated by the number 10. This device comprises a pair of signal transmission tubes 2A and 2*b*. These tubes are a flexible hollow tube, which can carry a detonating or deflagrating signal along its interior. An adhesive plastic bead 4 is used to secure the signal transmission tubes to each other and allow ease of handling and rapid deployment in field applications. The signal transmission tubes are often constructed with an outer abrasion resistant plastic layer of polyethylene or nylon, 6, with an inner layer, 8, of a plastic such as Surlyn@ that provides adherence of the explosive powder to the ID of the tube. A thin layer of explosive powder such as HMX and Al is coated on the ID of the tubes 12.

Another feature of the present invention is the ease of separating two tubes in the field. Prior art such as that disclosed in U.S. Pat. No. 5,001,981 illustrates a method of enclosing two discrete signal transmission tubes by an outer sheath, which coextensively covers the tubes. As disclosed in the patent, the outer sheath is typically a polyolefin plastic material such as low-density polyethylene or polyethylene blends. The problem encountered with a sheath in the field is in separating the two transmission lines. It is difficult to manufacture a sheath thin enough or with a consistent line of weakness to allow separating the fines with a minimum use of force. Typically pull strength of seven to ten pounds force is required to separate the lines. Worse yet, occasionally the sheath will slide down the tubes and bunch up rather than separating. The bunched sheath is about impossible to separate by pulling, and the sheath must be cut with a knife, with an associated risk of damaging the plastic signal transmission tubes.

Figure 3:
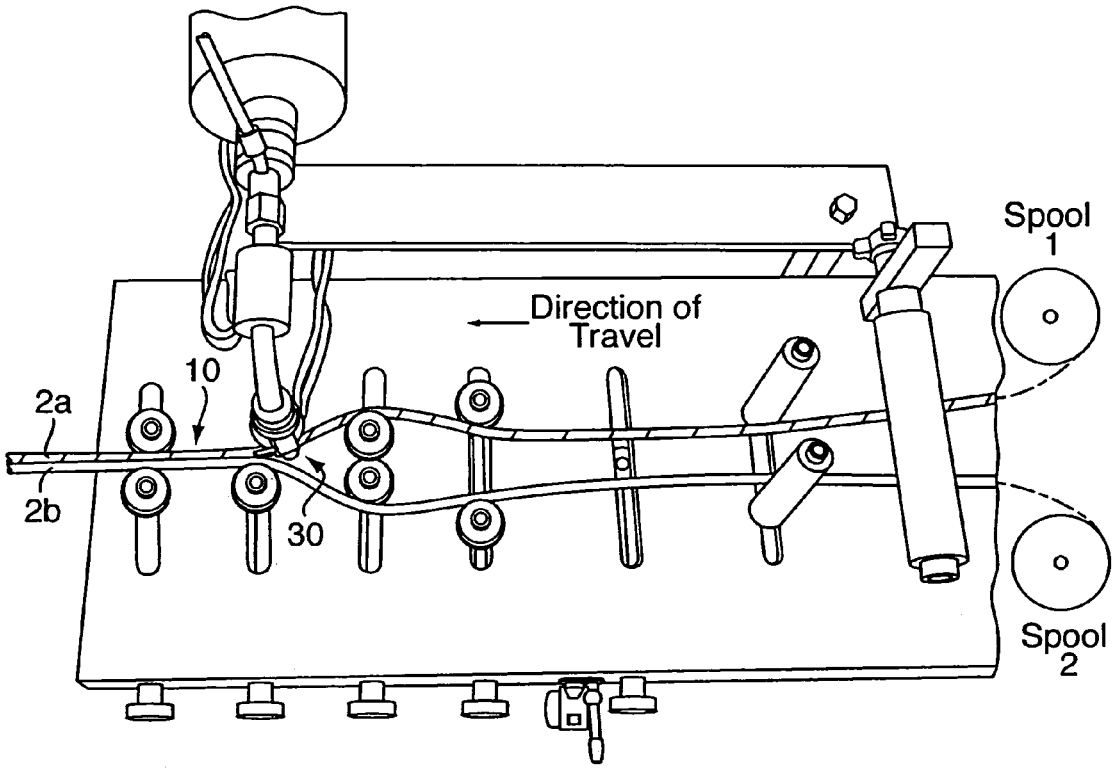
FIG. 3 is a plan view of the apparatus for joining two tubes fed past a nozzle in a fixture that aligns the tubes for introduction of the adhesive bead between the adjacent tubes.

From FIG. 3 it will be apparent that the individual tubes to be joined are of different or contrasting colors (white and black in this case) so that when joined together to form the assembly of FIG. 1 the resulting tube assembly will provide for ready identification of the individual tubes regardless of where one might inspect the tube assembly along this 5,000 foot length of transmission tubing. Other contrasting colors can be used for these conjoined tubes (red and orange) for example, with the red being "primary" and the orange "subsidiary".

The present invention allows careful control of the pulling force required to separate the two tubes. The separation force can be controlled to within two to three pounds, which allows rapid deployment in field use. By varying the amount and type of bead material, 4, the separation force can be adjusted within carefully controlled limits. This feature allows rapid separation of the two detonators and insertion into charges in the field. In fact, with this invention, the tubes could be totally and rapidly separated in the field if this became required. Also by eliminating the sheath, the overall diameter of the redundant signal transmission tubes is reduced in diameter, allowing for a smaller and lighter package. This feature is extremely important to the soldier in the field.

Typical signal transmission tubes, or shock tubes, are manufactured with an outer diameter of about 3.0 mm. (0.118"). For military applications, a slightly smaller diameter shock tube with an outer diameter of about 2.54 mm (0.100") are used to reduce the size and weight of the package. In the manufacturing process for the redundant signal transmission system, two reels are placed on payoff stands. Each reel contains about 5,000 feet of signal transmission tubing with an O.D. of 2.54 mm. The individual tube ends are led over a horizontal table containing several guide sheaves (see FIG. 3).

Figure 4:
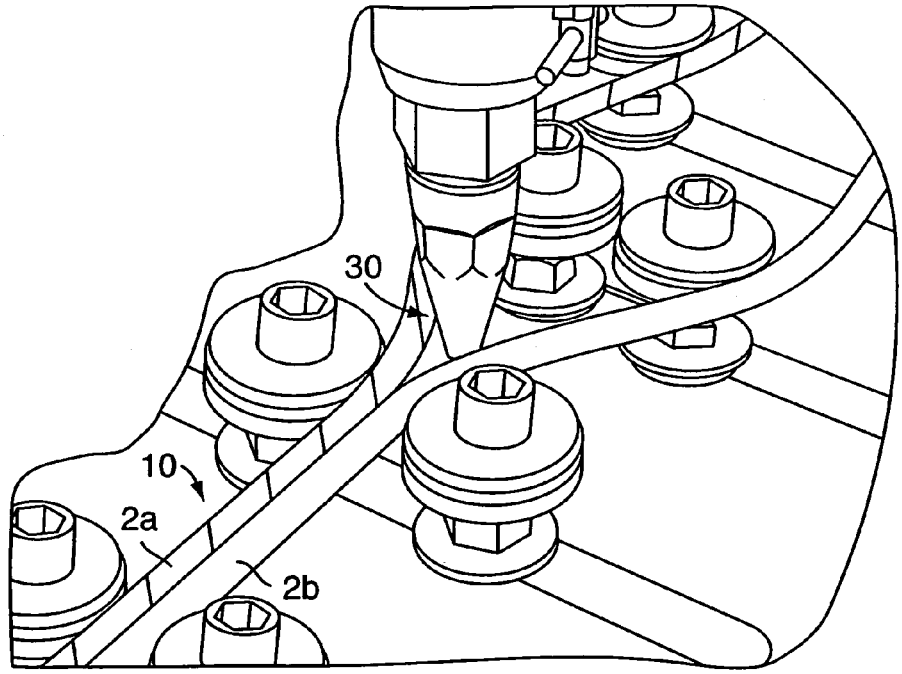
FIG. 4 is an enlarged view showing the nozzle and nozzle opening for extruding the adhesive bead.

The tubes follow the guide rollers to a point where an extruder nozzle (see FIG. 4) is positioned between the two-signal transmission tubes (one black and one white). A plastic bead (not shown) is extruded from the nozzle 30 between the two tubes (2*a* and 2*b*). Spring loaded rollers press both tubes against the extruded plastic bead issuing from the nozzle opening, forcing contact between the bead and each tube. Either forced air or water can be used to cool and solidify the bead. Once solidified, the bead adheres to the two tubes and provides a redundant signal transmission system.

The bead material can be any plastic material with good adhesive properties to the plastic substrate. Typical plastic that can be employed is an EVA copolymer plastic with a Vinyl Acetate content ranging from 2% to 20%. A preferred range is about 12% vinyl acetate. By varying the vinyl acetate content, the pull force required to separate the two tubes can be varied. A higher vinyl acetate content will require a much higher separation force for the tubes. Also the quantity of the bead material extruded can be varied; a higher quantity of bead material will result in a higher separation force for the signal transmission tubes. Once manufactured, the redundant signal transmission product can be cut into discrete lengths with initiators and detonators affixed to the individual shock tube leads.

In most blasting applications, it is desirable for the field operator to be separated by an appropriate safety distance from the location of the blast. In military breaching operations, it is necessary to carry out the blasting as rapidly as possible. Therefore a rapid deployment system is required for field use.

Figure 2:
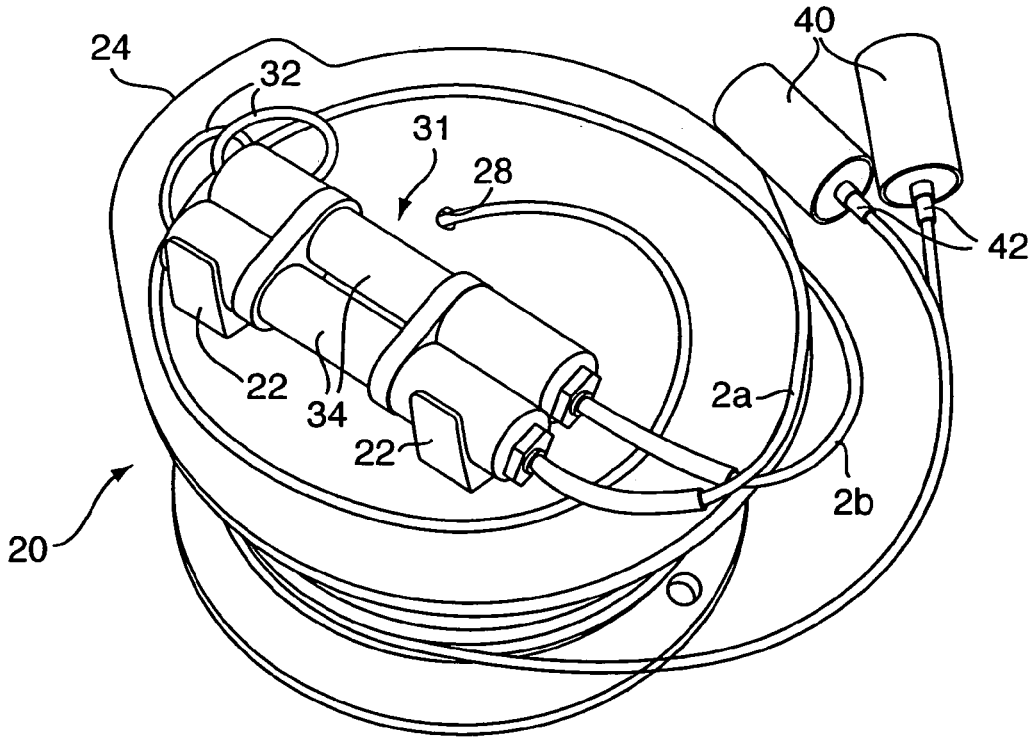
FIG. 2 shows a spool with the redundant signal transmission tubes wound on the spool with an initiation device for each signal transmission tubes securely mounted on the spool flange and two initiators in protective sleeves affixed to the other end of the signal transmission tubes.

A preferred embodiment of the present invention is to package the signal transmission system on a spool designed for rapid deployment of the product. FIG. 2 illustrates such a packaging method. A plastic spool 20 is used to package the redundant signal transmission leads. For a self-contained field system, it is essential to provide a factory assembled product for field use. FIG. 2 shows the redundant signal transmission leads with a M-81 firing device 30 affixed to one end of the shock tube leads 2*a* and 2*b*. A continuous length of the shock tube leads will be wound around the barrel of the spool 20. These lengths can vary from 20 feet to as much as 1,000 feet depending upon the application. A common length is 200 feet on a spool. On the opposite ends of the shock tube leads, a detonator 42 is typically crimped onto the end of the shock tube. For transport, a protective cap 40 will be used to cover the detonator until deployment is required. Retaining clips 22 securely affix the M-81 firing device to the spool flange. These clips and flange design allow the retention of the M-81 firing devices at rotational speeds of 1,500 RPM. This feature allows a soldier in the field to deploy the device from the back of a rapidly moving vehicle without dislodging the individual components. Another key feature is the use of a tapered exit hole 28 at the location on the flange where the leads exit the barrel of the spool. This gradually tapered exit hole provides protection from sharp bends that could inadvertently damage the individual signal transmission leads.

The M-81 firing device is connected to the individual shock tube leads by using an in-line initiator such as that disclosed in U.S. Pat. No. 6,272,996 B1. For additional waterproofness and a strain relief, a short length of heat shrinkable tubing can be applied over the end of the inline initiator. A raised flange 24 provides protection for the pull rings 32 on the M-81 firing device and prevents accidental activation of the firing devices.

In field use, the protective caps 40 are removed from the detonators 42. The detonators are then inserted into the explosive charge that will be detonated. A shaft is then inserted through the arbor hole in the spool and the spool is allowed to rotate, deploying the redundant signal transmission lead 10 while the operator retreats to a safer position. After deployment, the M-81 firing devices 30 are removed from the spool flange. By pulling and releasing the pull rings 32, a spring-loaded firing pin inside the M-81 will impact the percussion primer contained in the in-line initiator 34. Upon firing, a signal is transmitted through the shock tube leads to initiate the detonator 42.

Although the invention has been illustrated and described with respect to exemplary embodiments thereof, it should be understood by those skilled in the art that the foregoing and various other changes may be made without departing from the spirit and scope of the invention.

We claim:

1. A method of making and deploying a percussive redundant transmission tube assembly, said method comprising the steps of:

a. providing at least two storage spools of transmission tube of the type have a percussive powder contained therein, b. paying the tubes off their respective spools into a fixture designed to position the tubes in closely spaced relationship to one another, c. introducing an adhesive bead between the spaced tubes adjacent the fixture, said adhesive bead being extruded continuously along substantially the entire length of the tubes and providing the sole connection between the tubes, d. curing the adhesive bead to provide a redundant transmission tube assembly, and e. providing an additive for said adhesive, whereby the tubes can be readily split apart from one another manually for connection to separate initiation and detonation devices.

2. The method according to claim 1 wherein said adhesive comprises a copolymer of the same synthetic material defining the outer surfaces of said tubes.

3. The method according to claim 1 wherein said adhesive is selected to achieve a predetermined pulling force for separating the two tubes in the field.

4. The method according to claim 1 wherein said redundant transmission tube is itself wound on a reel having a flange at the end of the reel with an exit hole so that the redundant tubes can exit through said hole, and so that an initiator or detonation device can be attached to an individual tube after being separated from the adjacent tube to provide a packaged redundant transmission tube system.

5. The method according to claim 1 wherein each tube is of different external color for identification purposes.

* * * * *